US007067972B2

(12) United States Patent
Watanabe et al.

(10) Patent No.: US 7,067,972 B2
(45) Date of Patent: Jun. 27, 2006

(54) ELECTROLUMINESCENCE LIGHT EMITTING STEEL

(75) Inventors: Kimitaka Watanabe, Tokyo (JP); Hiroyuki Yamanaka, Chiba (JP)

(73) Assignee: Tomy Company, Ltd., Tokyo (JP)

( * ) Notice: Subject to any disclaimer, the term of this patent is extended or adjusted under 35 U.S.C. 154(b) by 8 days.

(21) Appl. No.: 10/624,682

(22) Filed: Jul. 23, 2003

(65) Prior Publication Data

US 2004/0113541 A1 Jun. 17, 2004

(30) Foreign Application Priority Data

Aug. 30, 2002 (JP) ..... 2002-254617
Apr. 25, 2003 (JP) ..... 2003-122792

(51) Int. Cl.
*H01J 1/62* (2006.01)
*H01J 63/04* (2006.01)

(52) U.S. Cl. ..... 313/500; 313/506; 313/512; 315/169.1; 315/169.3

(58) Field of Classification Search ..... 313/500, 313/506, 509, 512; 315/169.3, 169.1
See application file for complete search history.

(56) References Cited

U.S. PATENT DOCUMENTS 3,067,530 A 12/1962 Bolsey ..... 434/425
3,152,994 A 10/1964 Thornton, Jr. et al. .. 252/301.65

(Continued)

FOREIGN PATENT DOCUMENTS

| | | | |
|---|---|---|---|
| EP | 1 164 621 | | 12/2001 |
| GB | 735752 | | 8/1955 |
| GB | 2 063 544 | | 6/1981 |
| JP | 59-25197 | | 2/1984 |
| JP | 4-51795 | | 4/1992 |
| JP | 8-153582 | | 6/1996 |
| JP | 2001-52875 | | 2/2001 |
| JP | 2001-337633 | | 12/2001 |
| JP | 2002-50486 | | 2/2002 |
| JP | 2002-050474 | | 2/2002 |
| JP | 2002050486 | A * | 2/2002 |
| JP | 2003173880 | A * | 6/2003 |
| JP | 2003243964 | A * | 8/2003 |
| WO | WO 00/55743 | | 9/2000 |

OTHER PUBLICATIONS

Patent Abstracts of Japan; Publication No. 2003–243,964; Published Aug. 29, 2003.
Patent Abstracts of Japan; Publication No. 2003–173880, Published Jun. 20, 2003.
U.S. Appl. No. 10/447,275, filed May 29, 2003, Watanabe et al.,Tomy Company, LTD.
U.S. Appl. No. 10/620,422, filed Jul. 17, 2003, Watanabe et al., Tomy Company, LTD.
U.S. Appl. No. 10/637,574, filed Aug. 11, 2003, Watanabe et al., Tomy Company, LTD.
U.S. Appl. No. 10/637,590, filed Aug. 11, 2003, Watanabe et al., Tomy Company, LTD.
U.S. Appl. No. 10/651,210, filed Aug. 29, 2003, Watanabe et al., Tomy Company, LTD.
Patent Abstracts of Japanese Patent Application Publication No. 10189244, dated Jul. 21, 1998.

*Primary Examiner*—Joseph Williams
*Assistant Examiner*—Kevin Quarterman
(74) *Attorney, Agent, or Firm*—Staas & Halsey LLP

(57) ABSTRACT

An EL emitting sheet realizing various changes of light emission. The EL emitting sheet includes: a light-emitting layer containing electroluminescence light-emitting elements therein; and an electrode section having a plurality of electrode pairs which is disposed with a predetermined arrangement, wherein each of the electrode pairs includes first and second electrodes which are electrically separated from each other with a spacing region and disposed in one surface side of the light-emitting layer with a predetermined arrangement.

17 Claims, 11 Drawing Sheets

U.S. PATENT DOCUMENTS

| | | | | | |
|---|---|---|---|---|---|
| 3,290,537 | A | | 12/1966 | Logan | 313/510 |
| 3,443,332 | A | | 5/1969 | Christy | 40/544 |
| 3,641,533 | A | | 2/1972 | Sylvander | 340/870.34 |
| 3,740,616 | A | | 6/1973 | Suzuki et al. | 257/89 |
| 4,172,333 | A | | 10/1979 | Towsend | 40/544 |
| 4,345,249 | A | | 8/1982 | Togashi | 345/103 |
| 4,590,381 | A | | 5/1986 | Mendelson | 250/483.1 |
| 4,686,110 | A | * | 8/1987 | Endo et al. | 427/576 |
| 5,301,982 | A | | 4/1994 | Brotz | 283/83 |
| 5,319,491 | A | | 6/1994 | Selbrede | 359/291 |
| 5,351,143 | A | | 9/1994 | Sato et al. | 349/12 |
| 5,483,120 | A | | 1/1996 | Murakami | 313/506 |
| 5,551,905 | A | | 9/1996 | Billings et al. | 446/151 |
| 5,594,562 | A | | 1/1997 | Sato et al. | 349/12 |
| 5,597,183 | A | | 1/1997 | Johnson | 283/83 |
| 5,598,285 | A | | 1/1997 | Kondo et al. | 349/39 |
| 5,674,104 | A | | 10/1997 | Ohashi et al. | 446/132 |
| 5,677,546 | A | | 10/1997 | Yu | 257/40 |
| 5,680,160 | A | | 10/1997 | LaPointe | 345/173 |
| 5,737,051 | A | | 4/1998 | Kondo et al. | 349/149 |
| 5,793,158 | A | | 8/1998 | Wedding, Sr. | 313/493 |
| 5,852,509 | A | | 12/1998 | Coleman | 359/271 |
| 5,977,704 | A | | 11/1999 | Shi et al. | 313/504 |
| 6,084,007 | A | | 7/2000 | Narukawa et al. | 523/161 |
| 6,091,382 | A | | 7/2000 | Shioya et al. | 345/76 |
| 6,124,915 | A | | 9/2000 | Kondo et al. | 349/141 |
| 6,144,156 | A | * | 11/2000 | Lutschounig et al. | 313/506 |
| 6,183,262 | B1 | | 2/2001 | Tseng | 434/409 |
| 6,205,690 | B1 | | 3/2001 | Heropoulos et al. | 40/442 |
| 6,271,626 | B1 | | 8/2001 | Ford et al. | 313/503 |
| 6,297,812 | B1 | | 10/2001 | Ohara et al. | 345/173 |
| 6,326,735 | B1 | * | 12/2001 | Wang et al. | 315/169.3 |
| 6,341,004 | B1 | | 1/2002 | Kondo et al. | 349/141 |
| 6,348,908 | B1 | | 2/2002 | Richley et al. | 345/85 |
| 6,727,647 | B1 | | 4/2004 | Fukuda et al. | 313/506 |
| 2001/0018809 | A1 | | 9/2001 | Heropoulos et al. | 40/544 |
| 2002/0017857 | A1 | * | 2/2002 | Hashimoto et al. | 313/496 |
| 2002/0180712 | A1 | | 12/2002 | Sato et al. | 345/173 |
| 2003/0197461 | A1 | | 10/2003 | Fukuda et al. | 313/493 |
| 2004/0000863 | A1 | | 1/2004 | Miyake | 313/501 |

* cited by examiner

ELECTROLUMINESCENCE LIGHT EMITTING STEEL

BACKGROUND OF THE INVENTION

1. Field of the Invention

The present invention relates to an electroluminescence light emitting sheet.

2. Related Art

An electroluminescence, hereinafter, which may be referred to EL simply, material is known as one of light emitting materials. Various types of EL light emitting sheets have been developed and put to practical use. The EL light emitting sheet is generally formed by laminating a first electrode, a light-emitting layer, an insulating layer, i.e., a light reflecting layer, a second electrode and a protective layer in order. Generally, by applying an alternating voltage (AC voltage) between the fist electrode and the second electrode, a fluorescent material, i.e., EL light emitting elements, in the light-emitting layer emits light.

As another type of EL light emitting sheet, one having peculiar operation and effects is known (see, for example, Patent Document 1: Japanese Patent Laid-Open Publication No. Hei 8-153582). The EL light emitting sheet is formed by laminating an electrode section, an insulating layer and a light-emitting layer in order. The electrode section includes a plurality of electrode pairs each of which have a first electrode and a second electrode, which are formed like a comb. Then, an electrically conductive material in arbitrary shape is formed on the light-emitting layer as a film and the film is dried to be formed as a display electrode. Thereby, the parts in the light-emitting layer on which the display electrode is formed as a film emit light. In the EL light emitting sheet, a display electrode having a shape corresponding to the taste of a user can be formed, and then a desired light emission shape can be obtained.

However, since the EL light emitting sheet disclosed in Patent Document 1 only emits light, it is monotonous and insipid. Such an EL sheet also has a disadvantage of not attracting attention in case of being used as, for example, a signboard or the like.

SUMMARY OF THE INVENTION

The present invention has been developed in view of the above-described circumstances.

An object of the invention is to realize various change of light emission.

In accordance with a first aspect of the present invention, the electroluminescence light emitting sheet comprises: a light-emitting layer containing electroluminescence light-emitting elements therein; and an electrode section comprising a plurality of electrode pairs which are disposed with a predetermined arrangement, wherein each of the electrode pairs includes first and second electrodes which are electrically separated from each other with a spacing region and disposed in one surface side of the light-emitting layer with a predetermined arrangement.

Preferably, each of the first and second electrodes is formed to have a comb-like pattern shape severally, and they are formed to be engaged with each other with a predetermined gap between their teeth with putting a spacing region between each tooth so that each tooth does not touch each other.

According to such an electroluminescence light emitting sheet, since the electrode section comprises a plurality of electrode pairs, it is possible to realize a plurality of light emitting modes which are different from one another in light emitting system and/or light emitting range, of a chart for light emission by controlling execution of voltage application to the first and second electrodes of the electrode pairs.

The gap between the first and second electrodes which are next to each other is preferably about 0.1–2.0 mm. The widths of the first and second electrodes is preferably about 0.1–5.0 mm.

In the electroluminescence light emitting sheet, each of the first and second electrodes may comprise a deposited aluminum layer. Preferably, the deposited aluminum layer has a thickness of about 300–1,000 Å. More preferably, the deposited aluminum layer has a thickness of about 400–800 Å.

The first electrodes may be allowed to receive an application of AC voltage individually and the second electrodes are connected with one another and grounded.

Preferably, when an electrically conductive material is placed on the light-emitting layer, the electrode section allows to form a closed circuit between the conductive material and an electrode pair receiving the application of AC voltage through the placed light-emitting layer. The gap between the first and second electrodes which are next to each other is preferably about 0.1–2.0 mm, and the widths of the first and second electrodes is preferably about 0.1–5.0 mm. More preferably, the gap between the first and second electrodes which are next to each other is about 0.2–0.3 mm, and the widths of the first and second electrodes themselves are about 0.2–0.5 mm.

DETAILED DESCRIPTION OF THE PREFERRED EMBODIMENTS

Hereinafter, the preferred embodiments of the present invention will be described in detail by reference to the attached drawings.

A. EL Light Emitting Sheet

1. Whole Configuration

Figure 1:
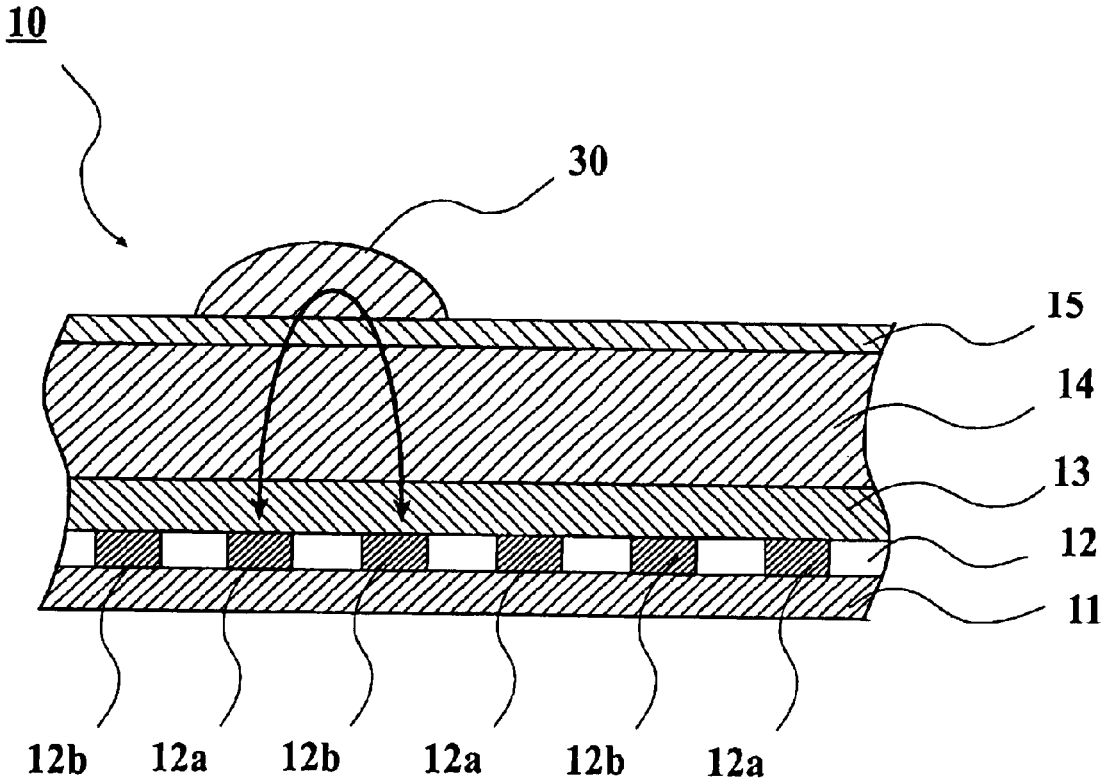
FIG. 1 is a partially enlarged sectional view of a principal part of an EL light emitting sheet according to an embodiment of the invention.

FIG. 1 is an enlarged sectional view of a principal part of an EL light emitting sheet 10 to which the present invention is applied. In FIG. 1, the EL light emitting sheet 10 is formed by laminating a base layer 11, an electrode layer (electrode section) 12, a waterproof layer 13, an EL light-emitting layer 14 and a top coat layer 15 in this order.

2. Detailed Configuration (1) Base Layer 11

The base layer 11 is made of an insulating material such as polyethylene terephthalate (PET) or the like. The base layer 11 may be configured as a base film (substrate sheet). In this case, the base film is made of a transparent or opaque resin. As the resin in this case, for example, PET is used. The base layer 11 may be made of glass.

(2) Electrode Layer 12

The electrode layer 12 having a predetermined electrode pattern is formed by depositing a metal such as copper, aluminum or the like on the base layer 11, and thereafter by performing etching or the like to the deposited metal layer. Alternatively, the electrode layer 12 is formed by depositing, for example, a pasty silver paste including silver powder, a pasty copper paste including copper powder, another electrically conductive paste such as carbon, or the like on the base layer 11 in a predetermined pattern by the screen printing process, and thereafter by performing a heat drying process of the paste.

Figure 2:
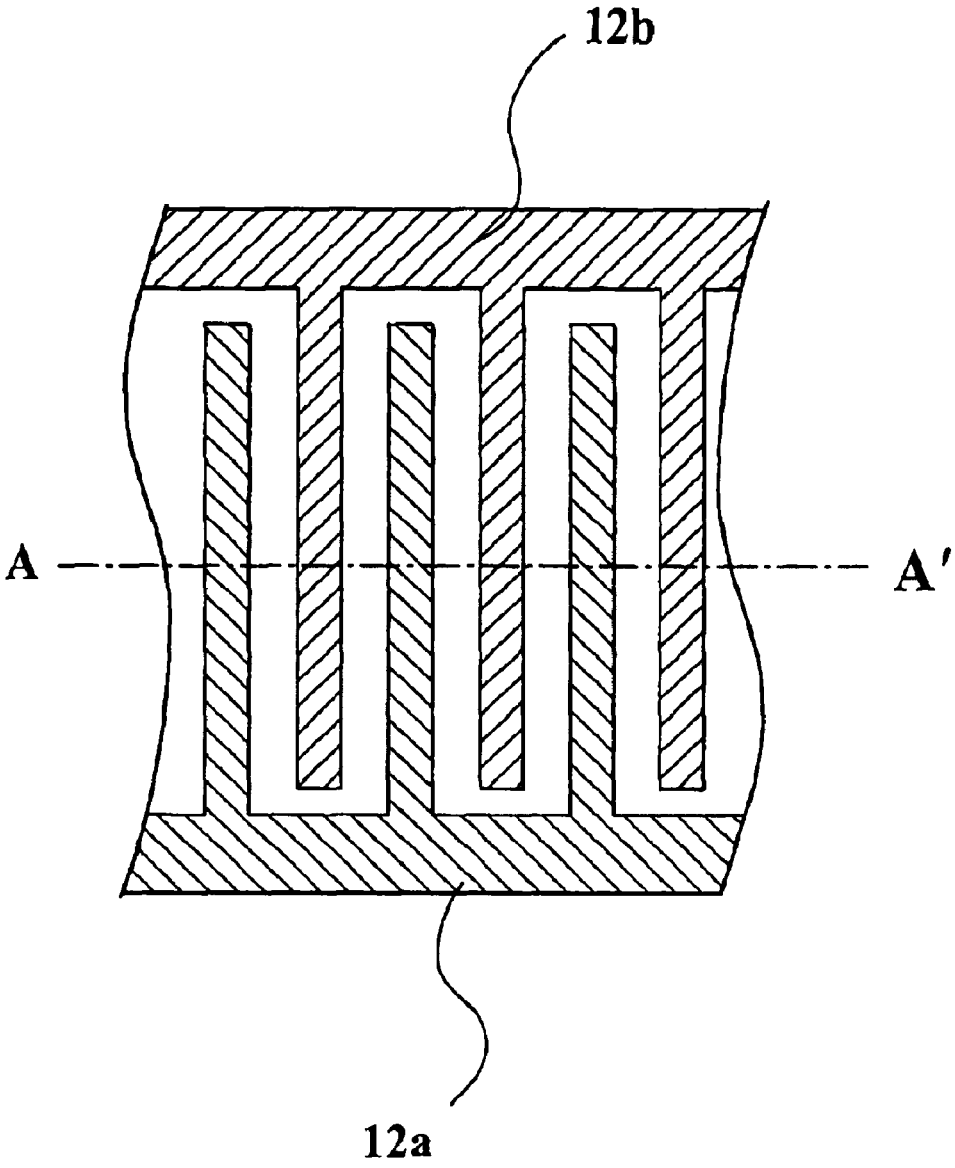
FIG. 2 is a schematic plan view showing a part of an electrode layer.

FIG. 2 is a schematic plan view showing a part of the electrode layer 12. The electrode layer 12 of FIG. 1 shows the cross section of the electrode layer 12, taken along the A–A' line of FIG. 2. As shown in FIG. 2, first electrodes 12*a*, 12*a*, . . . and second electrodes 12*b*, 12*b*, . . . are formed to have a comb-like pattern shape severally, and they are formed to be engaged with each other with a predetermined gap between their teeth with putting a spacing region between each tooth so that each tooth does not touch each other. Since each of first electrodes 12*a*, 12*a*, . . . is electrically connected with one another, each of them has the same electric potential. Since each of second electrodes 12*b*, 12*b*, . . . is also electrically connected with one another similarly, each of them has the same electric potential.

Preferably, a plurality of electrode pairs each of which has the first electrodes 12*a*, 12*a*, . . . and the second electrodes 12*b*, 12*b*, . . . , as described above, are disposed with a predetermined arrangement.

Incidentally, it is preferable to form the first electrodes 12*a* and the second electrodes 12*b* so that the spacing regions therebetween may substantially be the same per a unit area in a light emitting region.

The gap between the first electrode 12*a* and the second electrode 12*b* which are next to each other may be, for example, about 0.1–2.0 mm, and the width of the first electrode 12*a* and the second electrode 12*b* themselves may be, for example, about 0.1–5.0 mm, which are enough for light emission only.

However, when taking into account the case of placing a chart for light emission, of a thin line which is approximately parallel to the extending direction of comb-shaped pattern electrode, or a dot-shaped chart for light emission, the gap between the first electrode 12*a* and the second electrode 12*b* which are next to each other is preferably about 0.2–0.3 mm, and the widths of the first electrode 12*a* and the second electrode 12*b* themselves are preferably about 0.2–0.5 mm.

The reason for the above-described definition of gap or width is as follows.

When the gap between the first electrode 12*a* and the second electrode 12*b* is less than 0.2 mm, there is a large possibility that a light emission (spontaneous emission) which is not negligible is created in also a region onto which no conductive material 30 is placed. When the gap is more than 0.3 mm, particularly, in a case of placing a chart of a thin line, flecks of light emission stand up. Under conditions, that is, EL sheet with a light emitting region of 140 mm×92 mm, starting voltage of 250V to 270V and current of 100 mA to 130 mA, luminance of emitted lights from two EL light emitting sheets which have gaps of 0.2 mm and 0.15 mm, respectively, were compared. As a result, the luminance of emitted lights from the EL light emitting sheet having the gap of 0.2 mm was 3±0.5 candela and that of 0.15 mm was 6±0.5 candela which was approximately twice that of 0.2 mm gap case. Therefore, it is considered that when assuming a regular use condition in an ordinary room as an industrial product, the luminance of emitted light, of 3±0.5 candela which is obtained by the gap of 0.2 mm is a lower limit.

On the other hand, when the width sizes of the first electrode 12*a* and the second electrode 12*b* themselves are less than 0.2 mm, there are problems that the luminance of emitted lights may be lowered and the productivity may deteriorate by bridge or disconnection, occurred in mass production. When the width sizes are more than 0.5 mm, there is a problem that in a case of placing a dot-shaped chart for light emission by using a pen for drawing a thin line, probability of AC electric field formation with another electrode is lowered because the thin chart may be within the width of one electrode. When the width sizes are not more than 0.5 mm, the probability of AC electric field formation with another electrode is increased because the probability of the placed dot-shaped chart being out of the one electrode is much larger than that of the chart being placed at the center of the one electrode.

Thus, it is possible to increase the probability of AC electric field formation, to restrain occurrence of flecks of light emission for a chart such as a character, and to form a beautiful light emitting chart.

(3) Waterproof Layer 13

The waterproof layer 13 is a layer for protecting the electrode layer 12 and is made of a resin. As the resin, the following resins can be used. That is, they are, for example, a fluorocarbon resin such as a 4-fluorinated ethylene resin, fluororubber and the like; a silicon resin such as silicon rubber and the like. Another resin having a high sealing property such as an epoxy resin, an acrylic resin, a urethane resin, a polyester resin, an ethylene-vinyl acetate copolymer or the like, can also be used. These resins are cured by a method such as ultraviolet (UV) curing, infrared (IR) curing, two-liquid curing, heat curing and the like.

(4) EL Light-Emitting Layer 14

The EL light-emitting layer 14 is made of organic or inorganic EL light-emitting material elements (fluorescent material) sealed with a sealing resin. The EL light-emitting material elements are fixed with being dispersed in a transparent resin binder.

As the resin binder, a resin having a high dielectric constant such as a polyester resin or the like may suitably be selected. The EL light-emitting layer 14 has a thickness of about 30–40 μm, a withstanding voltage of about 50–150 V, and a dielectric constant of about 10–30. The thickness of the EL light-emitting layer 14 is preferably one and a half times as large as the diameter of an EL light emitting material element or more. With such a thickness, the surfaces of the EL light-emitting layer 14 is regarded as being smooth, and for example, their surface roughness is regarded as being 30 μm or less.

The EL light-emitting layer 14 configured as above emits the light of a predetermined luminescent color such as a bluish green color when an AC power supply voltage is applied between the first electrodes 12*a* and the second electrodes 12*b*.

(5) Top Coat Layer 15

The top coat layer 15 is stuck or fixed, closely to the EL light-emitting layer 14 to protect the EL light-emitting layer 14. The top coat layer 15 is laminated on the EL light-emitting layer 14 also for improving the smoothness of the EL light-emitting layer 14 and the removability of an electrically conductive material 30. When the EL light-emitting layer 14 itself can secure necessary smoothness and removability, it is unnecessary to provide the top coat layer 15 in particular.

As the top coat layer 15, the following resins can be used. That is, they are, for example, a fluorocarbon resin such as a 4-fluorinated ethylene resin, fluororubber and the like; a silicon resin such as silicon rubber and the like; a polyester resin; an urethane resin and the like. Since the main object of providing the top coat layer 15 is, as described above, to smooth the surface of the EL light-emitting layer 14 and to improve the removability of conductive material out of the surface thereof, the thickness of the top coat layer 15 is enough to be a degree which makes it possible to attain the object. On the other hand, it is suitable that the top coat layer 15 is as thin as possible. The reason for this is that the more the thickness is, the more the luminous intensity of the EL light-emitting sheet 10 decreases. The thickness is practically preferable to be about 1–2 μm as the effective value. Hereupon, the "effective value" means the size of the thickness of the top coat layer 15 placed on the uppermost part of the EL light-emitting layer 14. It is sufficient for obtaining the thickness of about 1–2 μm as the effective value to make the coating value of the thickness about 5–8 μm. Hereupon, the "coating value" means the thickness of the protection layer 15 when the coating is performed on a surface having no irregularities.

The top coat layer 15 may be formed by gluing a film-like or sheet-like member fixedly onto the EL light-emitting layer 14, or by placing a flexible material member thereto closely.

(6) Electrically Conductive Material 30

As the electrically conductive material 30, the following known materials can be used. That is, the conductive material includes: a stick type painting material such as a well-known ink, a pencil, a crayon, a pastel and the like; a sheet material having electrical conductivity (hereinafter referred to as a conductor sheet) and the like. As the stick type painting material such as the ink, the pencil, the crayon, the pastel and the like, ones including an organic or an inorganic coloring pigment may be used.

As the ink, one having the following properties is preferable. The properties are, for example, to have a surface resistance value equal to or less than $10^6\Omega\square$ in the state of being coated, to have optical transparency, and to include at least one kind of powder of the electrically conductive materials such as indium oxide, tin oxide, antimony, zinc oxide and the like, in a solvent. Further, as the ink, an electrically conductive polymer such as polyethylene dioxi thiophene and the like or a mixture of the electrically conductive polymer with the powder of the electrically conductive material may be used. In this case, it is possible to make the ink emit light for a long period until removal of the ink by wiping or the like. Moreover, the electrically conductive material 30 may be composed of water or a solvent, which have a high dielectric constant. In this case, the electrically conductive material 30 can easily be removed by drying it with a dryer, or by wiping it with a tissue, a piece of gauze, a sponge and the like.

3. Operation and Function

The electrically conductive material 30 is attached on the top coat layer 15 with a desired pattern. The attachment of the electrically conductive material 30 is performed by drawing with a brush, a pencil, a pastel, a crayon or the like, by performing printing with an ink jet printer or screen printing, by sticking an electrically conductive sheet, or the like. In the state, an AC power supply voltage is applied between the first electrode 12*a* and the second electrode 12*b*. Incidentally, the electrically conductive material 30 may be attached on the top coat layer after the AC power supply voltage has previously been applied.

Then, by the attachment of the electrically conductive material 30 on the top coat layer, an AC electric field is formed in the EL light-emitting layer 14, and only the portion thereof just under the attached electrically conductive material 30 emits light locally. That is, since the EL light-emitting layer 14 has a high dielectric constant, a circuit composed of the first electrode 12*a*, the EL light-emitting layer 14, the electrically conductive material 30, the EL light-emitting layer 14, the second electrode 12*b* and the like is formed to create an AC electric field in the EL light-emitting layer 14. Then, the portion of the EL light-emitting layer just under the attachment part of the electrically conductive material 30 emits light. On the other hand, the intensity of the AC electric field at the rest portion of the EL light-emitting layer 14 just under the part where the electrically conductive material 30 is not attached is insufficient for the EL light-emitting layer 14 to emit light, and consequently the rest portion does not emit light. The thickness and the dielectric constant of the EL light-emitting layer 14 or the like are set in order that the portion of the EL light-emitting layer just under the attached electrically conductive material 30 may emit light selectively.

When the electrically conductive material 30 is liquid, there is a case where the electrically conductive material 30 permeates the EL light-emitting layer 14 to reach the waterproof layer 13 through a scratch, a pinhole or the like. However, the waterproof layer 13 prevents the further permeation of the electrically conductive material 30. Moreover, the waterproof layer 13 also prevents the permeation of moisture or humidity in the air.

4. Advantageous Effects

According to the present embodiment, an AC electric field is formed at the portion of the EL light-emitting layer 14 just under the attached electrically conductive material 30, and only the portion locally emits light. This thing indicates that, when the electrically conductive material 30 is attached to the top coat layer 15 in the same pattern as a desired pattern, a light emitting with the desired pattern can be obtained. Consequently, an EL light emitting sheet 10 with which a user can easily produce a desired light emitting pattern can be provided.

The electrode layer 12 of the EL light emitting sheet 10 is, as described above, formed by deposition of a metal. When it is intended to form the electrode layer 12 by, for example, deposition of aluminum, the thickness of the electrode layer 12 is preferably about 300–1,000 Å ($10^{-10}$ m), more preferably about 400–800 Å. Since the electrode layer 12 is very thin and is formed by deposition of aluminum, if a user, for example, scratches the EL light emitting sheet with a cutter or strikes a nail, only a part of the electrode layer 12 contacting with the cutter or the nail, is melted almost simultaneously with the shortage. Consequently, the worst case where the whole of the electrode layer 12 is shorted is not generated, and the user does not receive electric shock.

The luminescent color of the EL light emitting sheet 10 can be changed by forming the EL light-emitting layer 14 by sealing the EL light-emitting elements with a coloring pigment mixed therein, by disposing a color filter between the EL light-emitting layer 14 and the top coat layer 15, by coloring the top coat layer 15, or by mixing a coloring pigment with the electrically conductive material 30.

B. EL Light Emitting Display System

Figure 3:
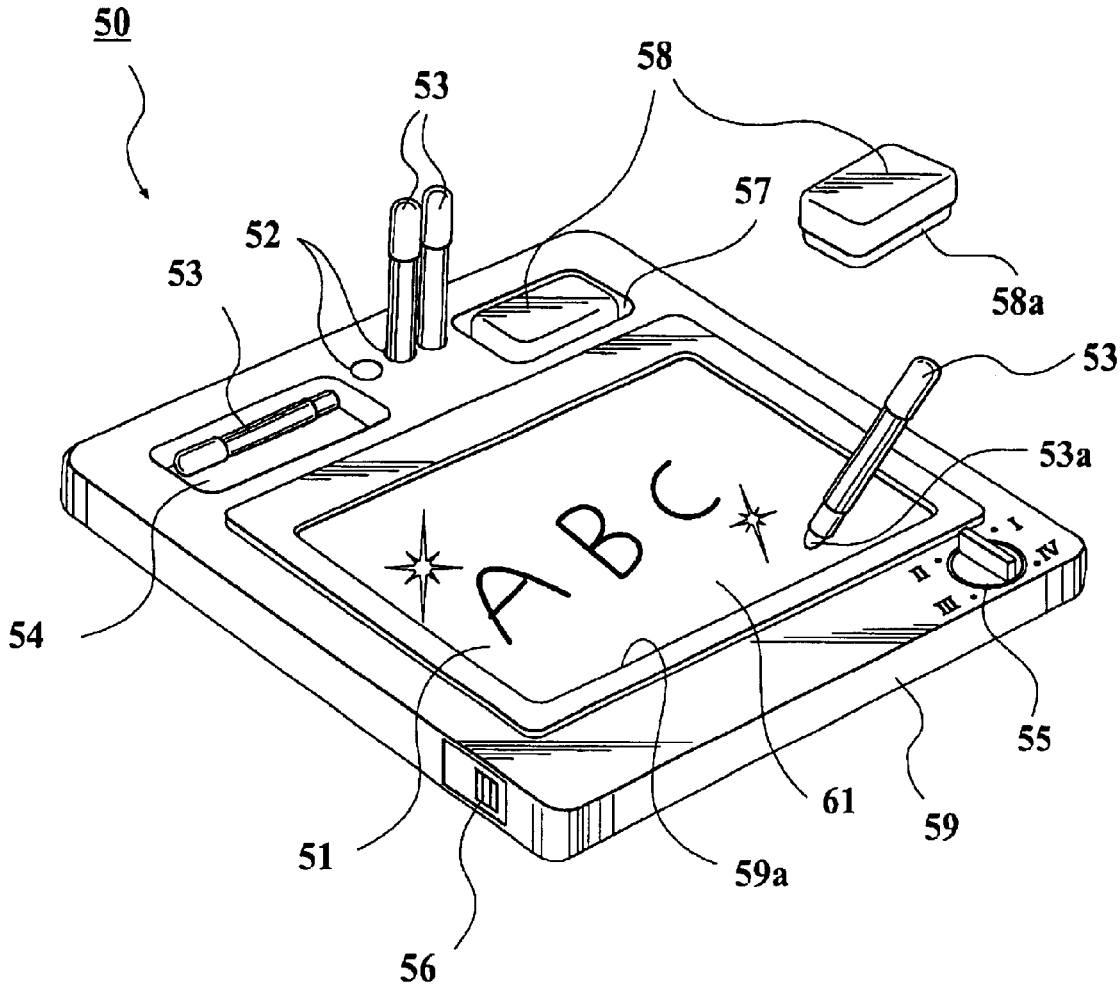
FIG. 3 is a perspective view of the external appearance of a drawing board.

FIG. 3 is a perspective view showing the external appearance of a drawing board 50 as an example of an EL light emitting display system incorporating the above-mentioned EL light emitting sheet therein.

1. Whole Configuration

In the drawing board 50, a main body 59 with a shape like a board having a predetermined thickness holds the EL light emitting sheet 51 which is provided in the inside of the main body 59. The EL light emitting sheet 51 having the top coat layer 15 on the top surface thereof is exposed from an opening 59*a*. The drawing board 50 is configured to be provided with a highlight pen 53 having a pen point 53*a* made of an impregnating material impregnating the electrically conductive material 30 using electrically conductive ink which includes a fluorescent material, holders 52 for holding the highlight pens 53 in the state of standing up, a tray 54 having a shape of a recess capable of holding the highlight pens 53 in the state of lying on their sides in the inside of the tray 54, a removal member 58 carrying a sponge 58*a* which is superior in water absorbing property, for removing the electrically conductive member 30 from the top surface of the EL light emitting sheet 51, a tray 57 for holding the removal member 58 to allow the removal member to be taken out thereof, a change-over switch 55 for switching the light-emitting modes, and a power supply switch 56.

2. How to Use

A user may take a pen 53 out of the tray 54, and may draw an arbitrary light emitting chart by applying the electrically conductive material 30 on a drawing screen 61, namely the top surface part of the top coat layer 15 exposed from the opening 59*a*. In FIG. 3, a word "ABC" is drawn. When the power supply switch 56 is turned on, a closed circuit is formed with the electrically conductive material 30, the electrodes 12*a*, 12*b*, and the like. As a result, the EL light-emitting layer 14 emits light, and the emitted light is transmitted through the electrically conductive material 30 to be radiated. That is, since the lower parts where the pen 53 has drawn emit light, the drawing acts as if the characters "A", "B" and "C" themselves were emitting light.

3. Detailed Configuration (1) Electrode Pattern

Figure 4:
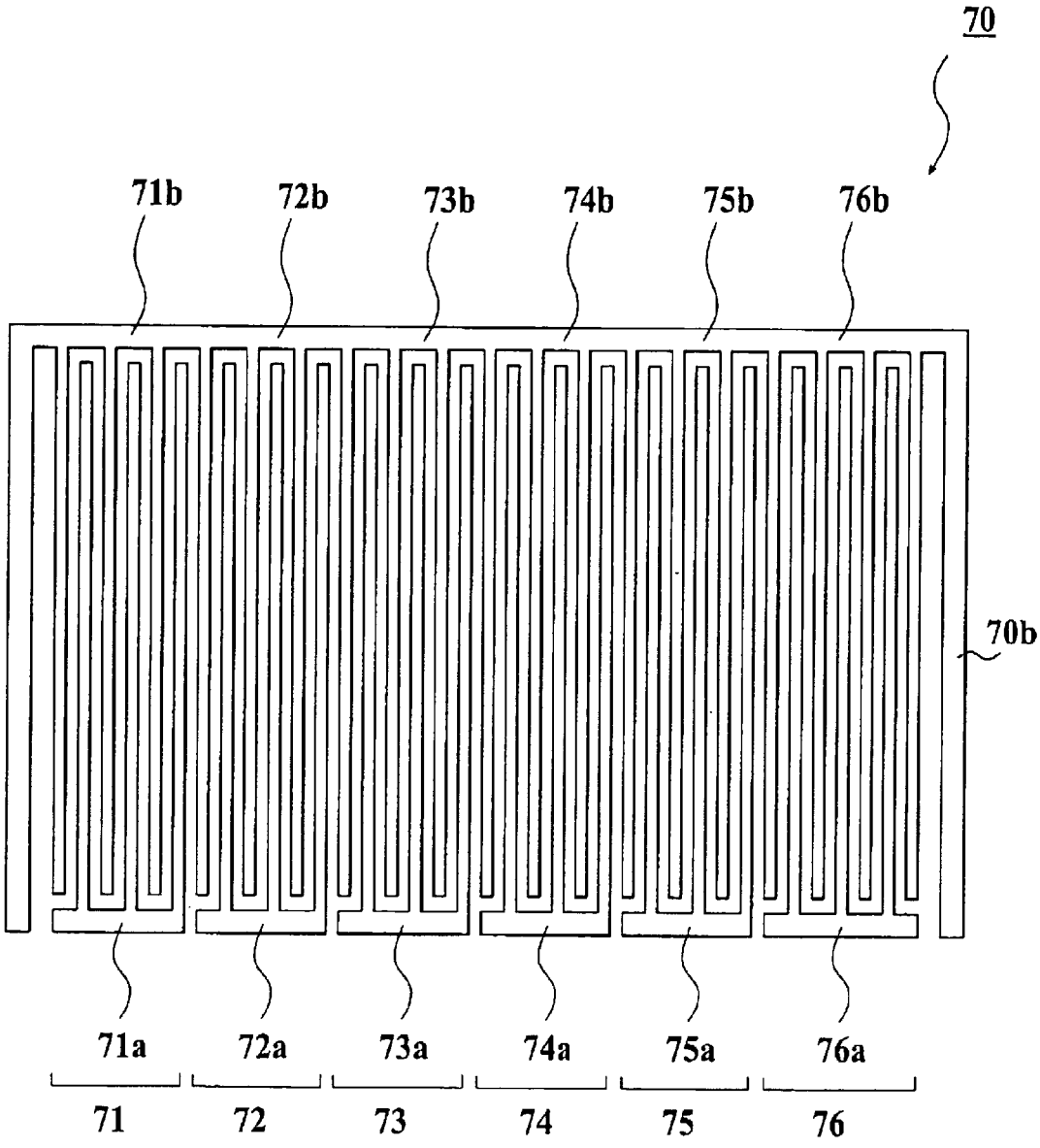
FIG. 4 is a plan view showing an example of the external shape of the electrode pattern of the EL light emitting sheet built in the drawing board.

Next, an electrode pattern of the EL light emitting sheet 51 built in the drawing board 50 will be described. FIG. 4 is a plan view showing the outline of the electrode pattern 70 of the EL light emitting sheet 51 built in the drawing board 50. The electrode pattern 70 means the shape of the electrode layer 12 formed on the base layer 11. In the figure, an electrode 71*a* and an electrode 71*b* constitute an electrode pair 71, and the electrode 71*a* and 71*b* have substantially the same figures as the comb-like pattern shapes of the electrodes 12*a* and 12*b*. The electrode pattern 70 includes six electrode pairs 71–76 having substantially the same configuration as the electrode pair 71 severally. The electrode pairs 71–76 are aligned. The upper end parts of the electrodes 71*b*–76*b* of respective electrode pairs 71–76 in the figure are connected with one another to form an electrode line (earth line) 70*b* which is connected to the ground. On the other hand, the electrodes 71*a*–76*a* are not connected with one another.

When a predetermined voltage (AC voltage) is applied to each of the electrodes 71*a*–76*a*, each of the electrode pairs 71–76 takes the state capable of forming a closed circuit. To put it more concretely, when the electrically conductive material 30 is coated on the drawing screen 61 while the voltage is applied to all of the electrodes 71*a*–76*a*, a closed circuit is formed between the electrically conductive material 30 and an electrode pair at any place on the drawing screen 61 through the EL light-emitting layer 14 and the like. However, when the voltage is applied to only a part of the electrodes 71*a*–76*a*, only the part of the electrode pair corresponding to the electrode to which the voltage is applied can form a closed circuit (the sate may be referred to as a "closed circuit formation possible state", and a state other than the above-mentioned state may be referred to as a "closed circuit formation impossible state" in the present specification).

When taking into account the case of placing a chart for light emission, of a thin line which is approximately parallel to the extending direction of comb-shaped pattern electrode, or a dot-shaped chart for light emission, the gap between the first electrode 12*a* and the second electrode 12*b* which are next to each other is preferably about 0.2–0.3 mm, and the widths of the first electrode 12*a* and the second electrode 12*b* themselves are preferably about 0.2–0.5 mm, according to the same reason as the above-described one.

(2) Internal Circuits

Figure 5:
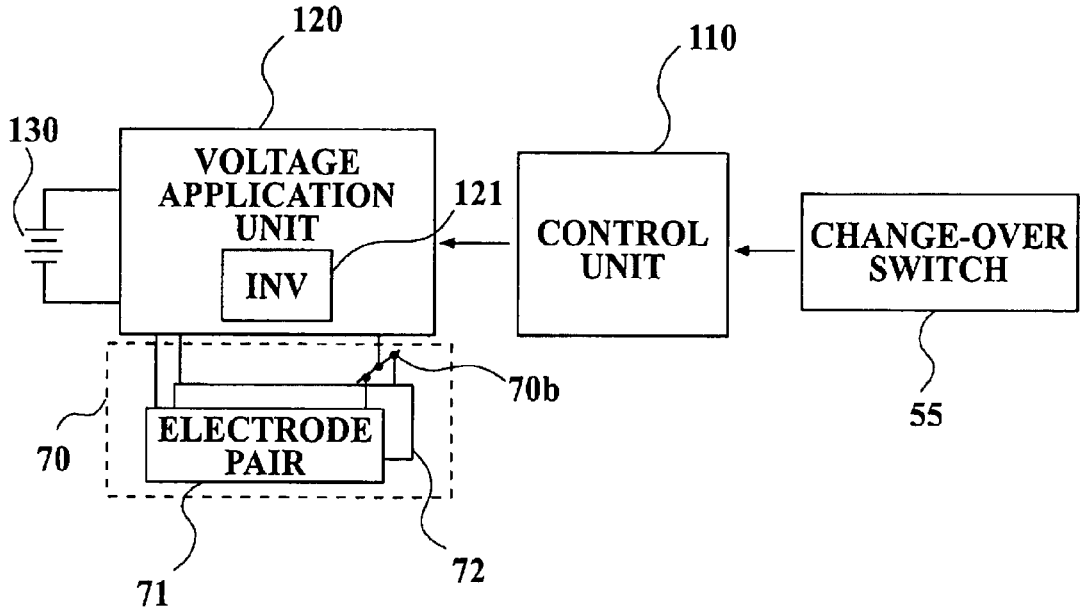
FIG. 5 is a functional block diagram of the drawing board.

FIG. 5 is a functional block diagram of the drawing board 50. In the figure, the drawing board 50 is provided with a control unit 110 composed of a central processing unit (CPU), a random access memory (RAM), a read only memory (ROM) and the like, a battery 130 composed of dry cells, and a voltage application unit 120. The voltage application unit 120 includes an inverter circuit 121 for converting a direct-current (DC) voltage supplied from the battery 130 to an AC voltage, and a booster circuit (not shown). The voltage application unit 120 applies an effective AC voltage of about 100–300 V between the earth line 70*b* of the electrode pattern 70 and each of the electrode pair 71–76 according to a control signal input from the control unit 110.

The control unit 110 stores programs instructing the procedures of applying the voltage to the electrode pattern 70 into the ROM at every light emitting mode. The control unit 110 reads a corresponding program according to a mode selection signal which is input from the change-over switch 55, and outputs a control signal to the voltage application unit 120.

Then, various light emitting modes can be realized by controlling the voltage application to the electrode pairs 71–76. In the drawing board 50, an entirely light-emitting mode (mode I), an entirely blinking mode (mode II), a sequentially light-emitting mode (mode III) and a wavy light-emitting mode (mode IV) are executed by the switching of the change-over switch 55.

(3) Light-Emitting Modes (a) Entirely Light-Emitting Mode

The entirely light-emitting mode is a mode in which an voltage is applied to all of the electrode pair 71–76 simultaneously and continuously. In other words, the mode is one in which all of the electrode pairs 71–76 are in the closed circuit formation possible state. If the electrically conductive material 30 is coated on all over the drawing screen 61, the whole surface of the drawing screen 61 continuously emits light.

(b) Entirely Blinking Mode

The entirely blinking mode is a mode in which a voltage is applied to all of the electrode pairs 71–76 simultaneously and intermittently. In other words, the mode is one in which all of the electrode pairs 71–76 simultaneously take the closed circuit formation possible state or the closed circuit formation impossible state alternately at predetermined time gaps. If the electrically conductive material 30 is coated on all over the drawing screen 61, the whole surface of the drawing screen 61 intermittently emits light.

(c) Sequentially Light-Emitting Mode

The sequentially light-emitting mode is a mode in which a voltage is accumulatively applied to the electrode pairs 71–76 in the order of their arrangement. In other words, the mode is one in which the electrode pairs 71–76 which have been in the closed circuit formation impossible state sequentially become the closed circuit formation possible state at predetermined time gaps. If the electrically conductive material 30 is coated on all over the drawing screen 61, an area part of one sixth of the whole area of the drawing screen 61 sequentially emits light (since there are six electrode pairs), and the area emitting light gradually increases. Incidentally, after all of the electrode pairs have become the closed circuit formation possible state, the application of the voltage to all of the electrode pairs 71–76 is stopped after a predetermined time to make all of the electrode pairs 71–76 be in the closed circuit formation impossible state. Thereby, the electrode pairs 71–76 return to the initial state, and the execution of the sequential light-emitting is repeated.

(d) Wavy Light-Emitting Mode

The wavy light-emitting mode is a mode in which a voltage is intermittently applied to the electrode pairs 71–76 in the order of their arrangement. In other words, the mode is one in which each of the electrode pairs 71–76 repeatedly transits the closed circuit formation possible state and the closed circuit formation impossible state with a predetermined time lag. If the electrically conductive material 30 is coated on all over the drawing screen 61, each area part of one sixth of the whole area of the drawing screen 61 sequentially emits light and does not emit light, and consequently the parts emitting light operates to appear as if they were moving while waving.

4. Advantageous Effects

As described above, in the drawing board 50, it is possible to draw a light emitting chart by applying the electrically conductive material 30 easily with the highlight pen 53. Moreover, it is also possible to remove the coated electrically conductive material 30 easily. Consequently, the repeating drawing of charts for light emitting can easily be realized.

Furthermore, a plurality of electrode pairs are formed in the EL light emitting sheet, and the control unit 110 controls the execution of the voltage application to each electrode pair. Thereby, light-emitting modes for light emitting charts can variously be changed, which makes it possible to realize interesting light emission together with the aid of the variation of the places where the electrically conductive material 30 is coated.

Incidentally, it is needless to say that the EL light emitting display system may be applied to other toys. In that case, the toys are not limited to the ones aiming to draw the light emitting charts like the EL light emitting display toys (for example, the drawing board 50), but the toys may be ones incorporating the EL light emitting display system as a part of them.

C. Variations of EL Light Emitting Sheet

1. Variation 1 of EL Light Emitting Sheet (1) Whole Configuration

Figure 6:
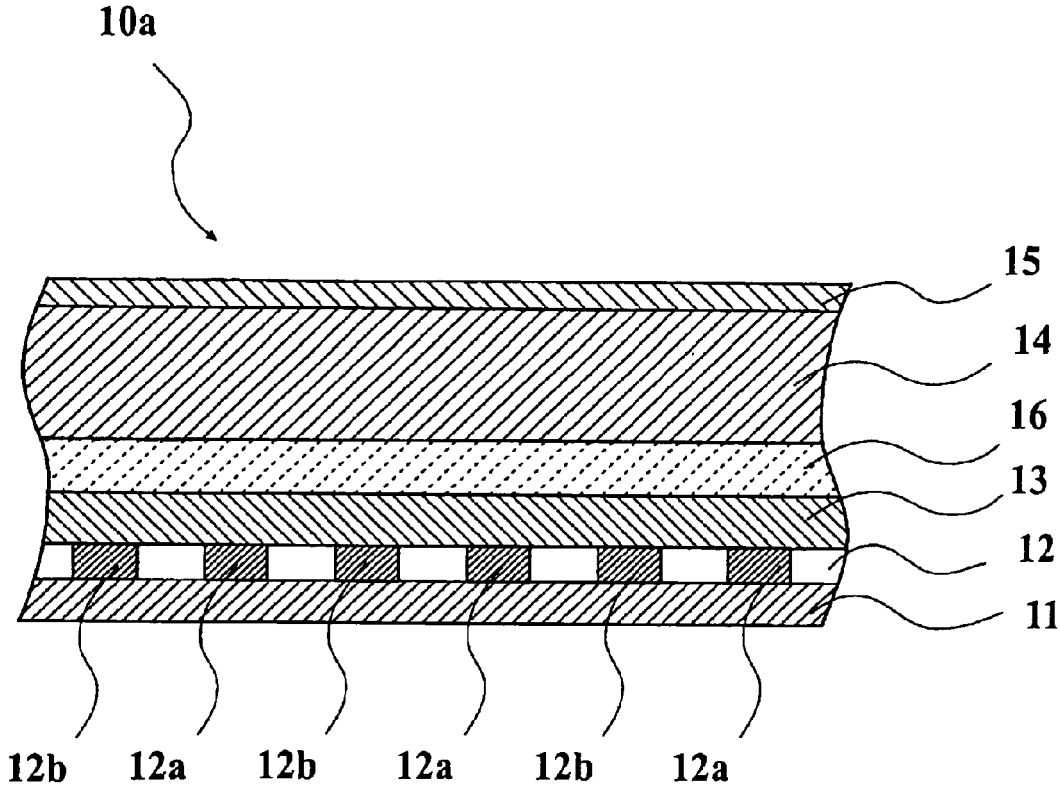
FIG. 6 is a partially enlarged sectional view of a principal part according to variation 1 of the EL light emitting sheet.

As shown in FIG. 6, the EL light emitting sheet 10*a* according to the variation 1 has a configuration in which a base layer 11, an electrode layer 12, a waterproof layer 13, a light reflecting layer 16, an EL light emitting layer 14 and a top coat layer 15 are laminated in this order. Since each structure of the base layer 11, the electrode layer 12, the waterproof layer 13, the EL light-emitting layer 14 and the top coat layer 15 is substantially the same as that of the EL light emitting sheet 10 in the embodiment of the present invention, the same reference numeral as that of the sheet 10 is attached to each element and the description for them are omitted. Mainly, the light-reflecting layer 16 will be described in the following.

(2) Detailed Configuration

The light-reflecting layer 16 is arranged between the waterproof layer 13 and the EL light-emitting layer 14. The light-reflecting layer 16 adheres to the EL light-emitting layer 14. The light-reflecting layer 16 has a thickness of about 10–30 μm, a withstanding voltage of about 200–300 V, and a dielectric constant of about 30–100, preferably about 60–100.

The light-reflecting layer 16 is made by dispersing inorganic powder which is ferroelectric powder such as barium titanate or Rochelle salt, into a resin functioning as a bonding agent such as an acrylic resin or the like. Since the inorganic powder such as the ferroelectric powder is a pigment showing white, the light-reflecting layer 16 becomes white, and therefore the light-reflecting layer 16 exhibits the light-reflecting function effectively.

2. Variation 2 of EL Light Emitting Sheet

Although in the variation 1, the waterproof layer 13 is arranged between the electrode layer 12 and the light-reflecting layer 16, in the variation 2, the waterproof layer 13 is arranged between the light-reflecting layer 16 and the EL light-emitting layer 14. In this case, the top coat layer 15 are not necessarily required.

3. Variation 3 of EL Light Emitting Sheet

Variation 3 is one that a further change is given to variation 1. The EL light emitting sheet according to the variation 3 has a structure in which a base layer 11, one of first and second electrodes 12*a* and 12*b*, a waterproof layer 13, the other of first and second electrodes 12*a* and 12*b*, a light reflecting layer 16, and an EL light-emitting layer 14 are laminated in this order. In this case, the top coat layer 15 are not necessarily required, and the light reflecting layer 16 may be omitted.

4. Variation 4 of EL Light Emitting Sheet

Variation 4 is one that a further change is given to variation 1. The EL light emitting sheet according to the variation 4 has a structure in which a base layer 11, one of first and second electrodes 12*a* and 12*b*, a light reflecting layer 16, a waterproof layer 13, the other of first and second electrodes 12*a* and 12*b*, and an EL light-emitting layer 14 are laminated in this order. In this case, the top coat layer 15 are not necessarily required.

Variation 5 is one that a further change is given to the EL light emitting sheet 10, 10*a* or 51 according to the embodiment, or one of variations 1–4. The EL light emitting sheet according to the variation 5 has a structure in which the EL light-emitting layer 14 and/or the light reflecting layer 16 has a permeation prevention function to water or the like, instead of or in addition to the waterproof layer 13. In this case, the top coat layer 15 is not necessarily required.

The EL light-emitting layer 14 with the permeation prevention function is composed of, for example, organic or inorganic EL light-emitting elements being phosphor particles or phosphorescent particles, and a transparent resin binder for fixing the EL light-emitting elements in the state of being dispersed. The variation 5 uses a resin having a waterproof property or a moisture-proof property as the resin binder. The following resins are used. That is, the resins are, for example, a fluorocarbon resin such as a 4-fluorinated ethylene resin, fluororubber and the like; a silicon resin such as silicon rubber and the like; the other epoxy resins; an acrylic resin; a urethane resin; a polyester resin; and a resin having a high sealing property such as an ethylene-vinyl acetate copolymer and the like. These resins are cured by a method such as the UV curing, the IR curing, the two-liquid curing, the heat curing and the like.

Further, as the resins constituting the light-reflecting layer 16 having the permeation prevention function, the following resins having the waterproof property or the moisture-proof property are used. The resins are, for example, a fluorocarbon resin such as a 4-fluorinated ethylene resin, fluororubber and the like; a silicon resin such as silicon rubber and the like; the other epoxy resins; an acrylic resin; a urethane resin; a polyester resin; and a resin having a high sealing property such as an ethylene-vinyl acetate copolymer and the like. These resins are cured by a method such as the UV curing, the IR curing, the two-liquid curing, the heat curing and the like.

According to the variation 4, since the light-reflecting layer 16 prevents the permeation of water and the like, the generation of electrolysis between the first electrode 12*a* and the second electrode 12*b* can be prevented. Moreover, the snapping (damage) of a wire caused by the oxidation of the first electrode 12*a* and the second electrode 12*b* can be prevented.

6. Variation 6 of EL Light Emitting Sheet

In the variation 6, the first electrode 12*a* and the second electrode 12*b* are formed on the back surface of a base film or a sheet of glass (base layer 11) which have a permeation prevention function. As the base film in this case, one made of, for example, polyethylene terephthalate (PET) is used.

According to the variation 6, since the base film or the sheet of glass prevents the permeation of water and the like from the front side, the generation of electrolysis between the first electrode 12*a* and the second electrode 12*b* can be prevented. Moreover, the snapping (damage) of a wire caused by the oxidation of the first electrode 12*a* and the second electrode 12*b* can be prevented.

Incidentally, the configuration is used in the case where the EL light emitting sheet is incorporated in a case body or the like. In the case where the EL light emitting sheet is incorporated in the case body as described above, the back surface side is generally sealed not to be exposed. Consequently, it is needless to consider the attachment of water and the like from the back surface side. If necessary, it is enough to coat the exposing electrodes with a resin having the permeation prevention function, or to perform the alumite processing of the exposing electrodes.

Incidentally, although the first electrode 12*a* and the second electrode 12*b* are provided on the back surface of the substrate sheet in the variation 6, the first electrode 12*a* and the second electrode 12*b* may be provided with putting the substrate sheet between them.

7. Variation 7 of EL Light Emitting Sheet

Figure 7:
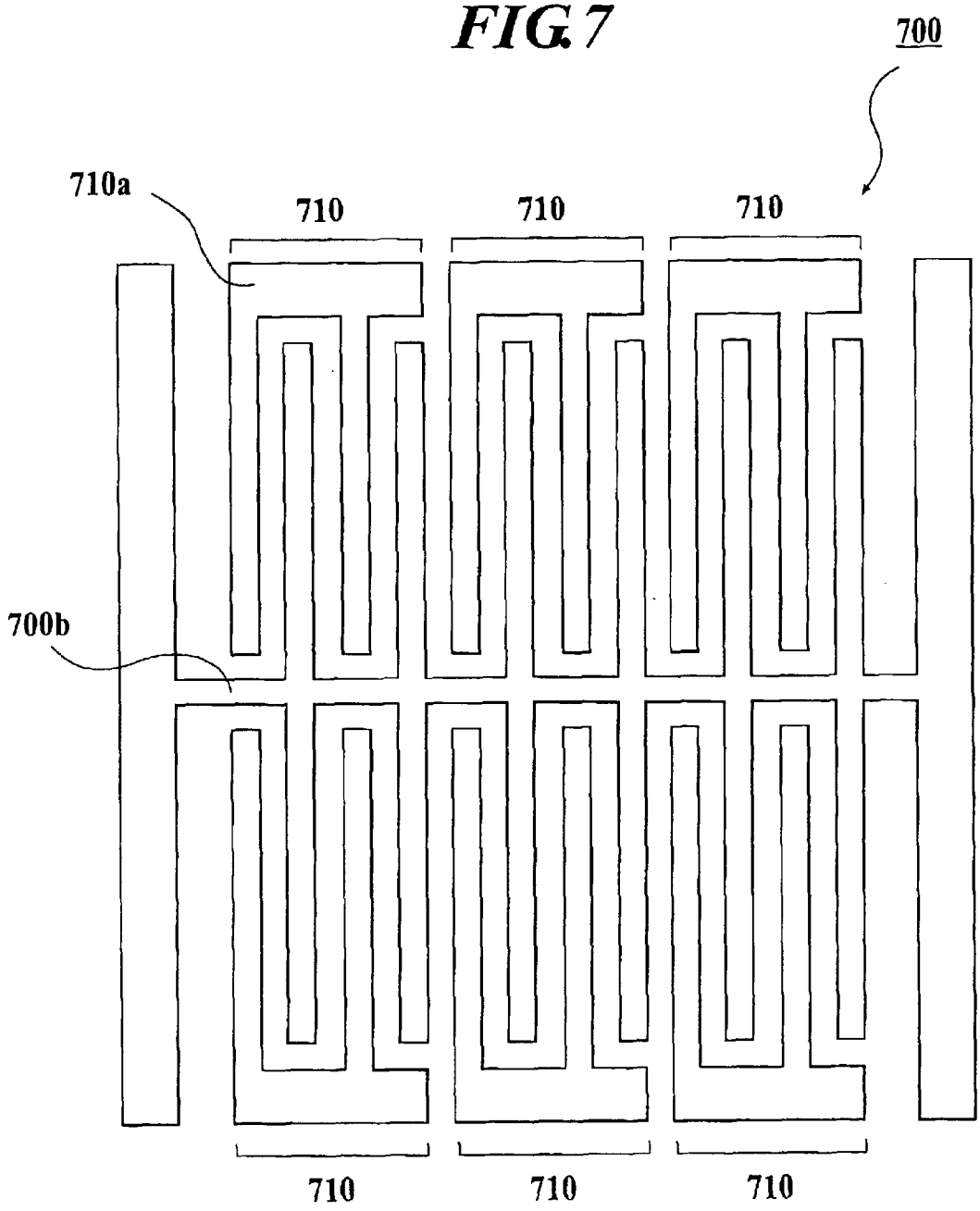
FIG. 7 is a plan view showing the external shape of the electrode pattern according to variation 7 of the EL light emitting sheet.

FIG. 7 shows the outline of the electrode pattern of the variation 7. In the figure, the electrode pattern 700 is a two dimensional arrangement composed of six comb-shaped electrode pairs 710 in all, three of which are arranged at the upper row in the right and left direction in the figure, and the other three of which are arranged at the lower row in the right and left direction in the figure. Moreover, the electrode pairs 710 are arranged so that the electrodes of each electrode pair are engaged in the upper and lower direction in the figure. Then, the electrode end of the earth side electrode of each electrode pair is integrally formed as an earth line 700*b* between the upper row electrode pairs and the lower electrode pairs of the two rows. In a case of adhering a chart for light emission, of a thin line, or in a case of adhering a dot-shaped chart for light emission, the gap of about 0.2–0.3 mm, between the first electrode 12*a* and the second electrode 12*b* which are next to each other is preferable, and the width sizes of the first electrode 12*a* and the second electrode 12*b* themselves, of about 0.2–0.5 mm, are preferable.

By means of the electrode pattern 700, a wide variety of light emitting patterns can be formed with the six electrode pairs in all.

Furthermore, owing to the arrangement of the earth line 700*b* between the upper row electrode pairs and the lower row electrode pairs of the two rows, the gap of the upper row electrode pairs and the lower row electrode pairs can be narrowed. That is, if a displacement side electrode 710*a* is arranged between the upper row electrode pairs and the lower row electrode pairs of the two rows, it is impossible to connect the upper row electrode 710*a* and the lower row electrode 710*a* cannot connected with each other, and then it is necessary to arrange them with a predetermined space between them. Consequently, the gap between the upper row and the lower row of the two rows becomes wide, and the gap becomes clear in some light emission patterns. On the other hand, if the earth line 700*b* is arranged at the center, it becomes possible to remove, or at least to reduce, the defect as above.

1. Variation 8 of EL Light Emitting Sheet

Figure 8A:
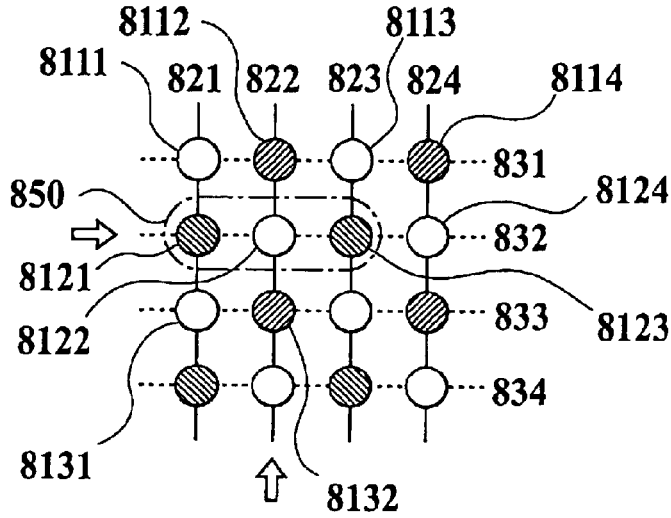
FIGS. 8A, 8B and 8C show the electrode section (electrode layer) according to variation 8 of the EL light emitting sheet schematically.
Figure 8B:
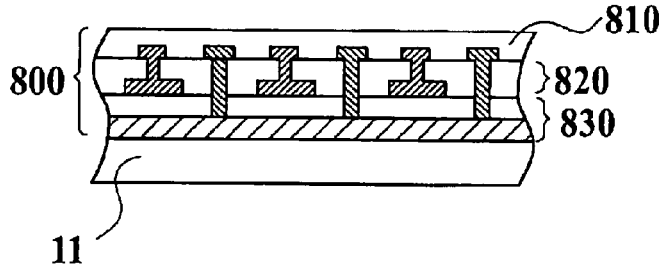
Figure 8C:
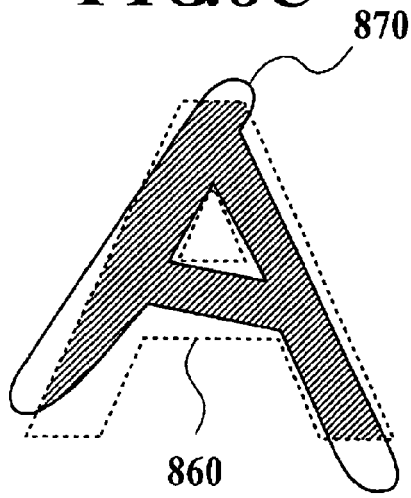

FIGS. 8A, 8B and 8C show the outline of the electrode section of the variation 8. The variation 8 is provided with an electrode section (electrode layer) 800 using a printed circuit board. FIG. 8A is a plan view of an enlarged substantial part of the electrode section 800 viewed from the side of an EL light-emitting layer. FIG. 8B is a sectional view of the electrode section 800. The electrode section 800 has a three-layer configuration composed of a first electric potential line layer 830, a second electric potential line layer 820 and an electrode terminal layer 810. In the first electric potential line layer 830, a plurality of first electric potential lines 831, 832, 833 and 834 extending in the right and left direction in FIG. 8A are formed in parallel to one another. In the second electric potential line layer 820, a plurality of second electric potential lines 821, 822, 823 and 824 extending in the upper and lower direction in FIG. 8A are formed in parallel to one another. In the electrode terminal layer 810, the terminals' via holes, which are connected to any one of the first electric potential lines 831–834 or the second electric potential lines 821–824, are two-dimensionally arranged. In FIG. 8A, black circles indicate the terminals' via holes connected to the first electric potential lines, and white circles indicate the terminals' via holes connected to the second electric potential lines. The white circles and the black circles are alternately arranged in staggered fashion. For example, the terminals connected to the first electric potential line 831 are terminals, and the terminals connected to the second 8112 and 8114 electric potential line 821 are terminals 8111 and 8131.

A first voltage is applied to the first electric potential lines 831–834, and a second voltage is applied to the second electric potential lines 821–824. The lines to which the voltages are applied are selected and controlled by the control unit. To put it concretely, for example, the first electric potential line 832 is selected as the line to which the first voltage is applied, and the second electric potential line 822 is selected as the line to which the second voltage is applied. In this case, the terminals 8121 and 8123 take the electric potential of the first voltage applied to the first electric potential line 832, and the terminals 8122 and 8142 take the electric potential of the second voltage applied to the second electric potential line 822. Consequently, owing to the potential difference between the terminal 8121 and the terminal 8122, and the potential difference between the terminal 8122 and the terminal 8123, a region 850 enclosed by an alternate long and short dash line in FIG. 8A becomes closed circuit formation possible state.

By forming an EL light emitting sheet by the use of the electrode section 800, and by performing selection control of the electric potential lines to which predetermined voltages (AC voltages) are applied, regions in the closed circuit formation possible state or in the closed circuit formation impossible state can arbitrarily be controlled. For example, in a case that the electrically conductive material 30 is coated all over the drawing screen, it is possible to emit light, i.e., to change the light emission form, so that arbitrary characters or charts are raised up. Moreover, it is also possible to realize various light emission patterns such as enlargement of the area of parts emitting light in concentric circles.

Further, a using method which is shown in FIG. 8C can also be carried out. FIG. 8C is a plan view of a part of a drawing screen. The figure shows a supposed case where a user is practicing how to write a character "A". A region 860 enclosed by broken lines is in the closed circuit formation possible state, and a region 870 enclosed by solid lines is a part of the electrically conductive material 30 coated with a highlight pen as a light emitting chart. In this case, the hatched portion where the region 860 and the region 870 are superposed on each other emits light.

In a case of adhering the chart for light emission, of a thin line, or in a case of adhering the dot-shaped chart for light emission, the gap of about 0.2–0.3 mm, between the first electrode 12*a* and the second electrode 12*b* which are next to each other is preferable, and the width sizes of the first electrode 12*a* and the second electrode 12*b* themselves, of about 0.2–0.5 mm, are preferable.

D. Variations of EL Light Emitting Display System

1. Variation 1 of EL Light Emitting Display System

Figure 9B:
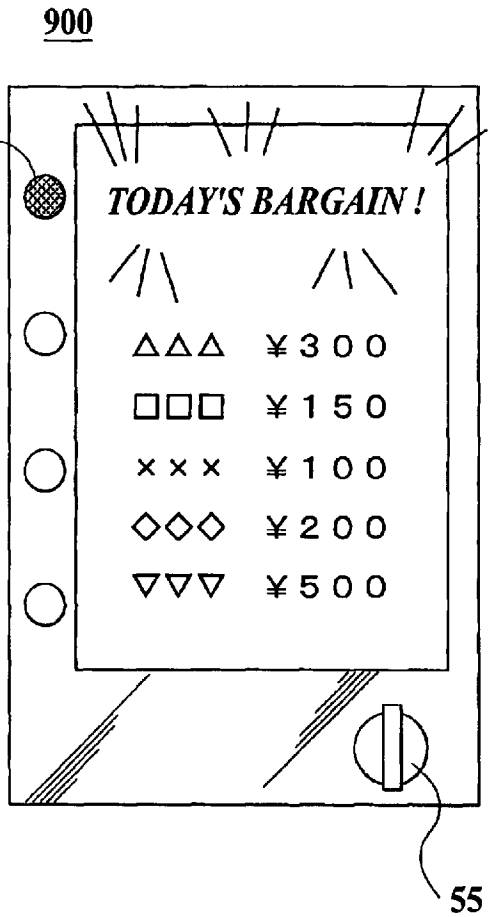
FIGS. 9A and 9B are plan views of a signboard according to variation 1 of the EL light emitting display system.
Figure 9A:
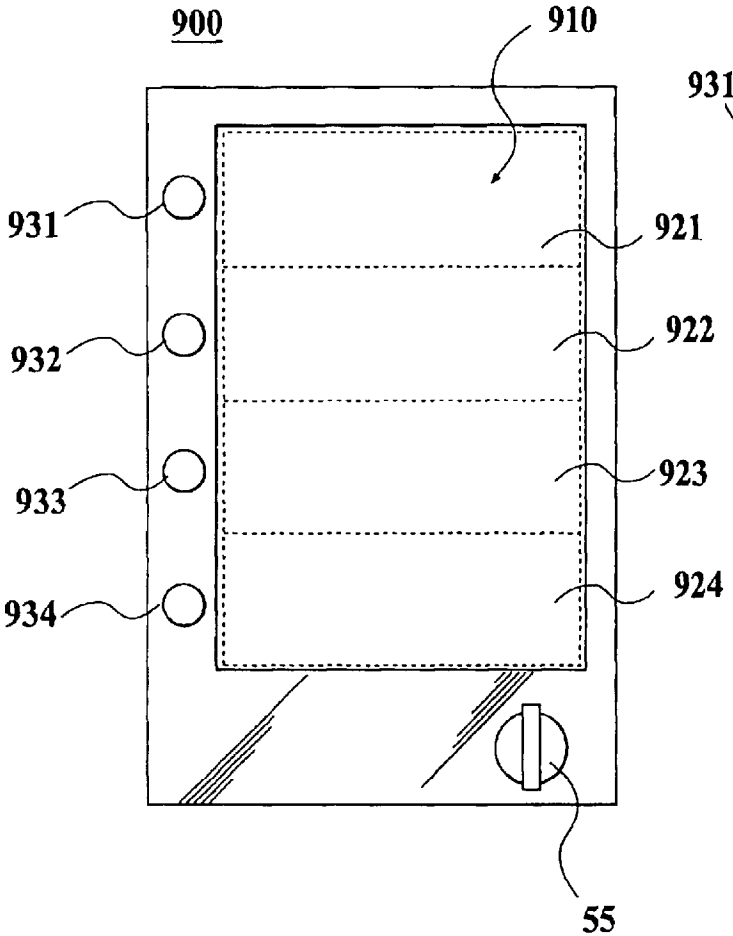

A signboard 900 according to a variation of the EL light emitting system is shown in FIGS. 9A and 9B. The signboard 900 is provided with an EL light emitting sheet 910 therein. The EL light emitting sheet 910 includes rectilinearly arranged four electrode pairs formed by depositing aluminum on a base layer 11. Buttons 931, 932, 933 and 934 (hereinafter referred to as buttons 930 comprehensively) corresponding to each of the electrode pairs 921, 922, 923 and 924 (hereinafter referred to as electrode pairs 920 comprehensively) are arranged on one side of a drawing screen, i.e., the top surface of the top coat layer of the EL light emitting sheet. The EL light emitting sheet 910 and the signboard 900 have the same configuration as those of the EL light emitting sheet 10 and the drawing board 50 except the arrangement configuration of the electrode pairs. The buttons 930 are made to be toggle switches. The buttons 930 are configured to output pushed signals when the buttons 930 are pushed down.

Figure 10:
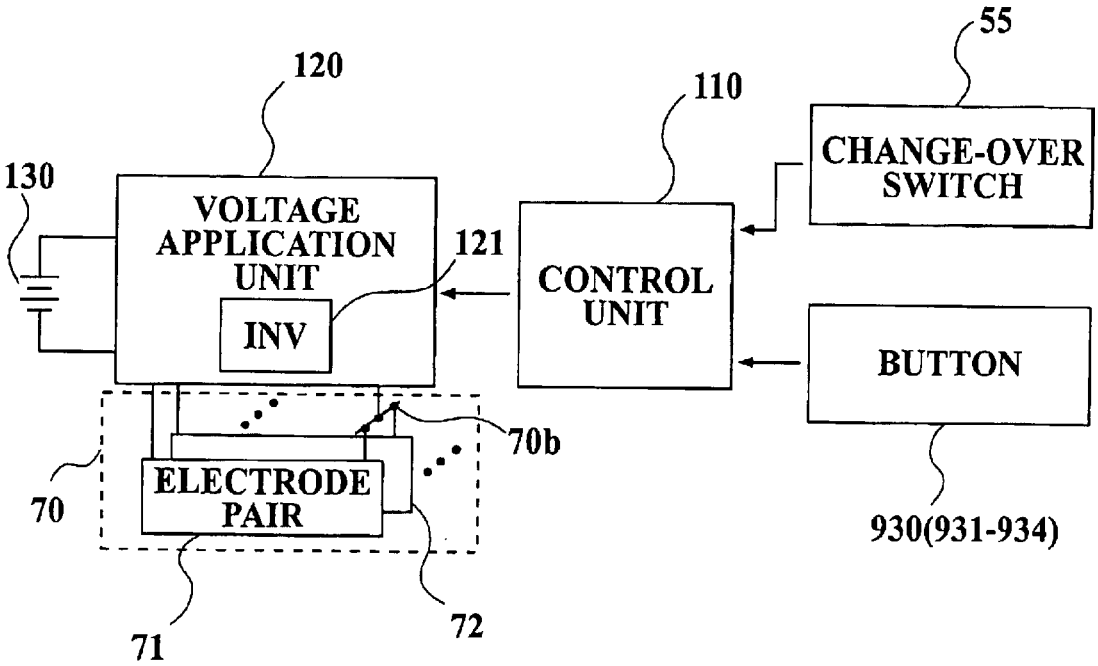
FIG. 10 is a control block diagram for the signboard according to variation 1 of the EL light emitting display system.

FIG. 10 is a control block diagram of the signboard 900. The configuration of the signboard is substantially the same as that of the drawing board 50 shown in FIG. 3. The configuration of the signboard is provided with the buttons 930. In FIG. 10, the control unit 110 selects and decides a region where light is to be emitted, that is, an electrode pair to which a predetermined voltage is applied on the basis of the pushed signal inputted from the buttons 930. For example, when the buttons 931 and 932 are pushed down, the control unit 110 selects and decides the electrode pairs 921 and 922. Then, the control unit 110 performs voltage application to the selected and decided electrode pairs 921 and 922 on the basis of the light emitting mode selected with the change-over switch 55.

FIG. 9B is a view showing an embodiment of the signboard 900 in the state in which the button 931 is pushed down. Since the electrode pair 921 is in the state of closed circuit formation possible state, the portion of the characters indicating "TODAY'S BARGAIN!", which have been drawn with the electrically conductive material 30, emit light in the region of the drawing screen where the electrode pair 921 is arranged.

Incidentally, the buttons 930 may be composed of change-over switches to make it possible to select light emitting modes in addition to the turning on and off, of the electrode pairs. In this case, for example, a light emitting form in which light emission is blinked in the region drawn as "TODAY'S BARGAIN!" while a continuous light emission is given in the other regions, can be realized.

2. Variation 2 of EL Light Emitting Display System (1). Schematic Configuration

Figure 11:
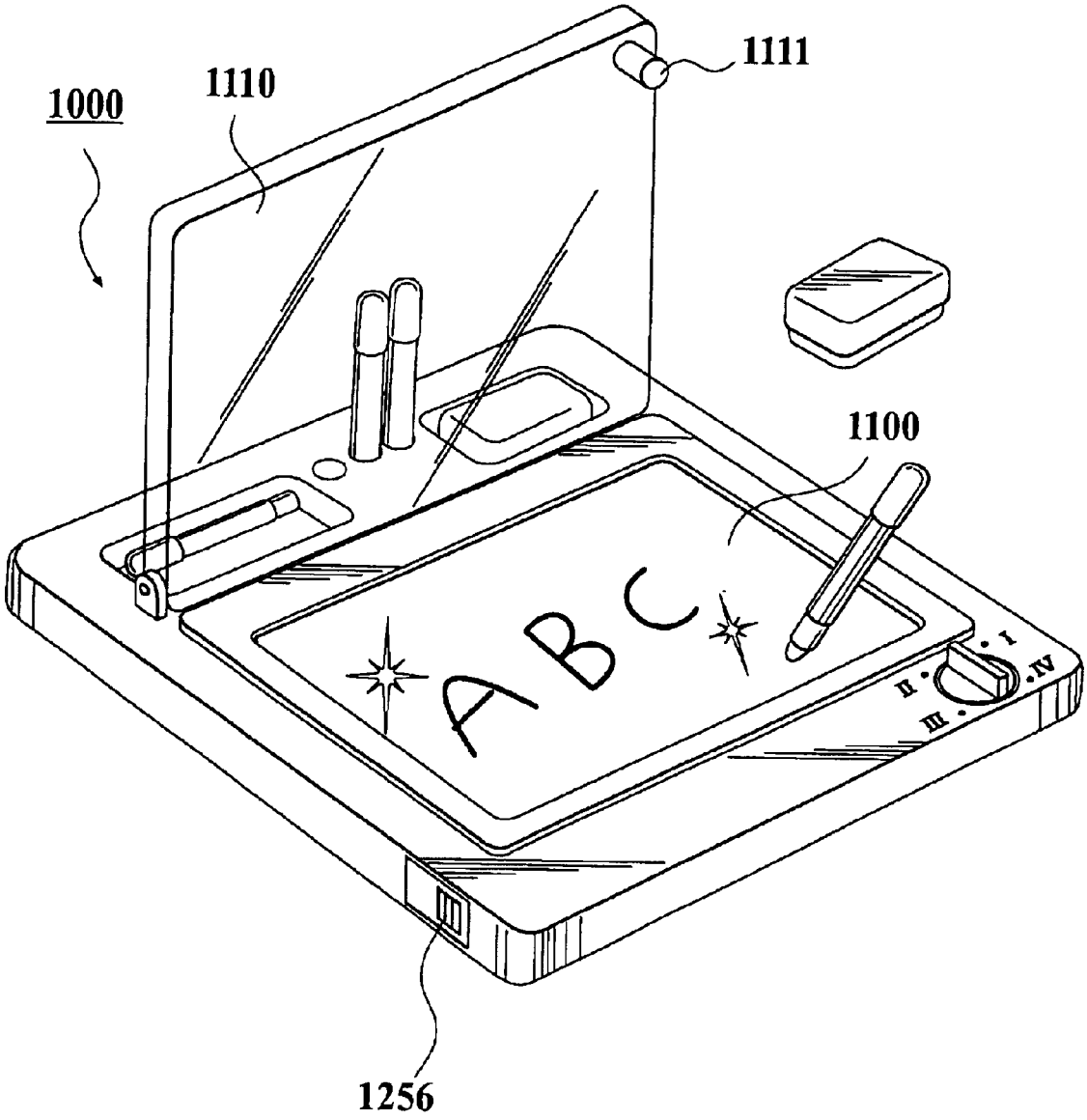
FIG. 11 is a perspective view of a drawing board according to variation 2 of the EL light emitting display system.

FIG. 11 is a perspective view showing an external appearance of a drawing board 1000 as an embodiment of the EL light emitting display system incorporating the above-mentioned EL light emitting sheets.

As shown in FIG. 11, the drawing board 1000 is provided with a transparent cover 1110 on an EL light emitting sheet 1100. The cover 1110 is configured to be capable of being opened and closed. On the back side of the cover 1110, a projection 1111 is annexed. The projection 1110 is provided to turn on a power supply control switch (not shown in the figure) which is arranged on the inside of the drawing board 1000 when the cover 1110 is closed. Other configurations and the like of the EL light emitting sheet 1100 are substantially the same as those of the drawing board 50.

(2). Function and Advantageous Effect

The EL light emitting display system does not work only by turning the power supply switch 1256 on. Only when both the power supply switch 1256 and the power supply control switch are turned on, the system does work to become in a closed circuit formation possible state. Therefore, even if the liquid electrically conductive material 30 penetrates into the EL light emitting sheet 1100 to short-circuit the electrode pair, no AC current are applied to the electrode pair unless the cover 1110 is closed. Accordingly, it is possible to enhance the safety.

E. Another Variation of the Invention (1) It is preferable to contain organic or inorganic colored pigment in the waterproof layer 13 of the EL light emitting sheet, to make the electrode pattern invisible from the front side by coloring. Such coloring enables not only making the electrode pattern invisible from the front side but also widening the range of choice for design from the front side. In a case of providing a light reflecting layer 16, it is required to arrange the light reflecting layer 16 near the EL light emitting layer in comparison with the waterproof layer 13.

(2) In the variation 2 of EL light emitting display system, a projection 1111 is annexed on the back side of the cover 1110, and when the cover 1110 is closed, the system works to become in a closed circuit formation possible state.

However, opening and closing of the cover 1110 may be detected by any one of appropriate mechanical, electrical and optical manners, to become in a closed circuit formation possible state only when the cover 1110 is closed. Alternatively, a structure in which the power supply switch 1256 is locked during the cover 1110 is opened, may also be used.

According to the invention, it is possible to realize many different types of changes of light emission.

The entire disclosure of Japanese Patent Application No. Tokugan 2002-254617 which was filed on Aug. 30, 2002, and Japanese Patent Application No. Tokugan 2003-122792 which was filed on Apr. 25, 2003, including specification, claims, drawings and summary are incorporated herein by reference in its entirety.

What is claimed is:

1. An electroluminescence light emitting sheet comprising:

a light-emitting layer containing electroluminescence light-emitting elements therein; and an electrode section including a plurality of electrode pairs which are disposed with a predetermined arrangement, wherein each of the electrode pairs includes first and second electrodes which are electrically separated from each other with a spacing region and disposed on one surface side of the light-emitting layer with a predetermined arrangement, wherein, when an electrically conductive material is placed on another surface side of the light-emitting layer which is opposite to the one surface side, the electrode section forms a closed circuit between the conductive material and at least one of the electrode pairs receiving an application of AC voltage, through the light-emitting layer.

2. The electroluminescence light emitting sheet as claimed in claim 1, wherein each of the first and second electrodes is formed to have a comb-like pattern shape of teeth severally, and the first and second electrodes are formed to be arranged with each other with a spacing region including a predetermined gap between adjacent teeth so that the teeth do not touch each other.

3. The electroluminescence light emitting sheet as claimed in claim 2, wherein the predetermined gap is about 0.1–2.0 mm.

4. The electroluminescence light emitting sheet as claimed in claim 3, wherein each of the first and second electrodes has a width that is about 0.1–5.0 mm.

5. The electroluminescence light emitting sheet as claimed in claim 1, wherein each of the first and second electrodes comprises a deposited aluminum layer.

6. The electroluminescence light emitting sheet as claimed in claim 5, wherein the deposited aluminum layer has a thickness of about 300–11000 Å.

7. The electroluminescence light emitting sheet as claimed in claim 6, wherein the deposited aluminum layer has a thickness of about 400–800 Å.

8. The electroluminescence light emitting sheet as claimed in claim 2, wherein the first electrodes are allowed to receive an application of AC voltage individually and the second electrodes are connected with one another and grounded.

9. The electroluminescence light emitting sheet as claimed in claim 2, wherein the predetermined gap is about 0.1–2.0 mm, and each of the first and second electrodes has a width that is about 0.1–5.0 mm.

10. The electroluminescence light emitting sheet as claimed in claim 2, wherein the predetermined gap is about 0.2–0.3 mm, and each of the first and second electrodes has a width that is about 0.2–0.5 mm.

11. The electroluminescence light emitting sheet as claimed in claim 1, wherein only a portion of the light-emitting layer just under the placed electrically conductive material locally emits light.

12. The electroluminescence light emitting sheet as claimed in claim 1, wherein, when the electrically conductive material is removed from the another surface side, a portion of the light-emitting layer on which the electrically conductive material was placed does not substantially emit light.

13. The electroluminescence light emitting sheet as claimed in claim 2, wherein the predetermined gap is more than 0.5 mm and not more than 2.0 mm.

14. The electroluminescence light emitting sheet as claimed in claim 13, wherein each of the first and second electrodes has a width that is more than 0.5 mm and not more than 5.0 mm.

15. The electroluminescence light emitting sheet as claimed in claim 8, wherein the predetermined gap is more than 0.5 mm and not more than 2.0 mm, and each of the first and second electrodes has a width that is more than 0.5 mm and not more than 5.0 mm.

16. The electroluminescence light emitting sheet as claimed in claim 1, further comprising a waterproof layer between the light-emitting layer and the electrode section.

17. The electroluminescence light emitting sheet as claimed in claim 1, wherein each of the first and second electrodes comprises a deposited copper layer.

* * * * *

UNITED STATES PATENT AND TRADEMARK OFFICE

CERTIFICATE OF CORRECTION

PATENT NO. : 7,067,972 B2
APPLICATION NO. : 10/624682
DATED : June 27, 2006
INVENTOR(S) : Kimitaka Watanabe et al.

It is certified that error appears in the above-identified patent and that said Letters Patent is hereby corrected as shown below:

Title Page and Column 1, lines 1 and 2

Please change the title from "ELECTROLUMINISCENCE LIGHT EMITTING STEEL" to --ELECTROLUMINESCENCE LIGHT EMITTING SHEET--.

Col. 16, line 3, change "11000" to --1000--.

Signed and Sealed this

Sixth Day of March, 2007

JON W. DUDAS
*Director of the United States Patent and Trademark Office*